United States Patent [19]

Makowski et al.

[11] Patent Number: 5,046,616

[45] Date of Patent: Sep. 10, 1991

[54] CARD DISPLAY PLAQUE

[76] Inventors: Jeffrey S. Makowski; Mark A. Makowski, both of 1105 Echo La., Bluffton, Ind. 46714-2804

[21] Appl. No.: 548,003

[22] Filed: Jul. 5, 1990

[51] Int. Cl.[5] ..... B65D 73/00

[52] U.S. Cl. ..... 206/467; 206/468; 206/470; 206/563; 206/564; 206/455; 40/156

[58] Field of Search ..... 206/39, 39.7, 444, 467, 206/468, 469, 470, 471, 472, 473, 486, 488, 489, 490, 563, 564, 456, 455; 40/124.2, 124.4, 156, 649

[56] References Cited

U.S. PATENT DOCUMENTS

| | | | |
|---|---|---|---|
| D. 211,186 | 5/1968 | Smith et al. . | |
| D. 292,651 | 11/1987 | Stratton . | |
| 423,059 | 3/1890 | Lear | 206/455 |
| 2,189,299 | 2/1940 | Rinn | 206/455 |
| 2,637,132 | 5/1953 | Helms et al. | 40/156 |
| 2,879,774 | 3/1959 | Siegel . | |
| 3,102,728 | 9/1963 | Booth . | |
| 3,371,439 | 3/1968 | Smith et al. | 40/156 |
| 3,463,309 | 8/1969 | Szostek | 206/470 |
| 4,016,972 | 4/1977 | Szamborski | 206/471 |
| 4,115,938 | 9/1978 | Belmuth et al. | 40/152 |
| 4,132,311 | 1/1979 | Glinert | 206/564 |
| 4,229,891 | 10/1980 | Keller | 40/653 |
| 4,322,001 | 3/1982 | Hurley . | |
| 4,333,253 | 6/1982 | Cooper | 40/152 |
| 4,408,693 | 10/1983 | Brewaeys et al. | 206/461 |
| 4,424,637 | 1/1984 | Leahy . | |
| 4,477,991 | 10/1984 | Drevitch et al. | 40/152 |
| 4,555,290 | 11/1985 | Graetz et al. | 206/563 |
| 4,679,341 | 7/1987 | Goldman | 40/156 |
| 4,790,088 | 12/1988 | Morvant | 40/124.5 |
| 4,829,691 | 5/1989 | Manjos et al. . | |
| 4,860,468 | 8/1989 | Cliborn . | |
| 4,895,252 | 1/1990 | Nomula et al. | 206/444 |
| 4,937,958 | 7/1990 | Stein et al. | 40/156 |

FOREIGN PATENT DOCUMENTS

| | | | |
|---|---|---|---|
| 2620258 | 3/1989 | France | 206/444 |

*Primary Examiner*—David T. Fidei
*Attorney, Agent, or Firm*—Richard L. Robinson

[57] ABSTRACT

A device for holding and displaying collectable cards and the like has a base including a planar portion having a card receiving area thereon for receiving a collectable card. The base includes a ridge upstanding from the planar portion and substantially circumscribing the card receiving area, except for an opening through the ridge that permits lateral access by a person's finger to a card received on the card holding area. The ridge has inner sidewalls delimiting the card receiving area and arranged orthogonally to each other. The adjacent inner sidewalls have laterally recessed corners set back from a point of intersection of imaginary extensions of the adjacent inner sidewalls, such that a corner of a collectable card, whose adjacent sides are in engagement with adjacent inner sidewalls of the ridge, would not engage the ridge, thereby preventing damage or deformation of the corner of the collectable card. A transparent removable cover includes a generally planar portion having a card retaining area thereon for lying atop and retaining a card received on the card receiving area of the base. The cover includes a groove shaped complementary to the ridge of the base portion for receiving the ridge therein in form-fitting relationship such that a card received on the card holding area of the base is sandwiched between the planar portion of the base and the planar portion of the cover.

10 Claims, 2 Drawing Sheets

CARD DISPLAY PLAQUE

BACKGROUND OF THE INVENTION

The invention involves a display plaque for mounting and displaying baseball cards or other similar items.

For many years, baseball cards have been available that feature a photograph of a professional player along with limited personal data such as his name and team on the front side of the card, and extensive personal and professional data on the reverse side of the card. Similar cards for other major sports, such as basketball and football, are also available. Collecting and trading such cards has become a popular activity among youthful sports fans, and the activity often carries on into adulthood as an enjoyable hobby. In some cases, the hobby involves buying and selling the collector cards, some of which are quite valuable to serious collectors because of their rarity or the acquired fame of the player depicted on the card.

Given the strong interest by persons ranging from youthful casual collectors to serious collectors and dealers in preserving their collections, there has arisen a need for adequate means for mounting and displaying valuable or otherwise important cards so that they can be appreciated without incurring damage.

It would therefore be desirable to provide a device for displaying a selection of collector cards in an attractive manner so that they can be readily viewed, while remaining protected from damage.

It would also be desirable to provide a device for displaying a selection of collector cards that would permit ready rearrangement of the selected cards or substitution of certain cards without requiring that the entire selection of cards be disturbed.

It would be desirable to provide a device for displaying a selection of collector cards that permits the cards to be mounted and removed quickly and easily, and without risk of damage or deformation of the card, especially the corners thereof.

These and other desires are met by the present invention, as will be appreciated from the descriptions of the invention set forth herein in the context of the preferred embodiments of the invention.

SUMMARY OF THE INVENTION

In accordance with one aspect of the present invention, a device for holding and displaying collectable cards and the like includes a base having a generally planar portion with a card receiving area thereon for receiving a collectable card. The base includes a ridge upstanding from the planar portion and substantially circumscribing the card receiving area, except for an opening through the ridge that permits lateral access by a person's finger to a card received on the card holding area. Also provided is a transparent removable cover including a generally planar portion having a card retaining area thereon for lying atop and retaining a card received on the card receiving area of the base. The cover includes a groove shaped complementary to the ridge of the base portion and receiving the ridge therein in form-fitting relationship such that a card received on the card holding area of the base is sandwiched between the planar portion of the base and the planar portion of the cover.

In accordance with another aspect of the present invention, a device for holding and displaying collectable cards and the like includes a base with a generally planar portion having a card receiving area thereon for receiving a collectable card. The base includes a ridge upstanding from the planar portion and substantially circumscribing the card receiving area. The ridge has inner sidewalls delimiting the card receiving area, with adjacent ones of the inner sidewalls being disposed orthogonally to each other. The adjacent inner sidewalls have laterally recessed corners set back from a point of intersection of imaginary extensions of the adjacent sidewalls, such that a corner of a collectable card, whose adjacent sides are in engagement with adjacent inner sidewalls of the ridge, does not engage the ridge, thereby preventing damage or deformation of the corner of the collectable card. Also provided is a transparent removable cover including a generally planar portion having a card retaining area thereon for lying atop and retaining a card received on the card receiving area of the base. The cover includes a groove shaped complementary to the ridge of the base portion and receiving the ridge therein in form-fitting relationship such that a card received on the card holding area of the base is sandwiched between the planar portion of the base and the planar portion of the cover.

It is an object of the present invention to provide a device for displaying a selection of collector cards in an attractive manner so that they can be readily viewed, while remaining protected from damage.

It is another object to provide a device for displaying a selection of collector cards that permits ready rearrangement of the selected cards or substitution of certain cards without requiring that the entire selection of cards be disturbed.

It is yet a further object of the present invention to provide a device for displaying a selection of collector cards that permits the cards to be mounted and removed quickly and easily, and without risk of damage or deformation of the card, especially the corners thereof.

Other objects and advantages of the present invention will be apparent from the following descriptions and drawings of preferred embodiments of the invention.

DETAILED DESCRIPTION OF THE PREFERRED EMBODIMENTS

Figure 1:
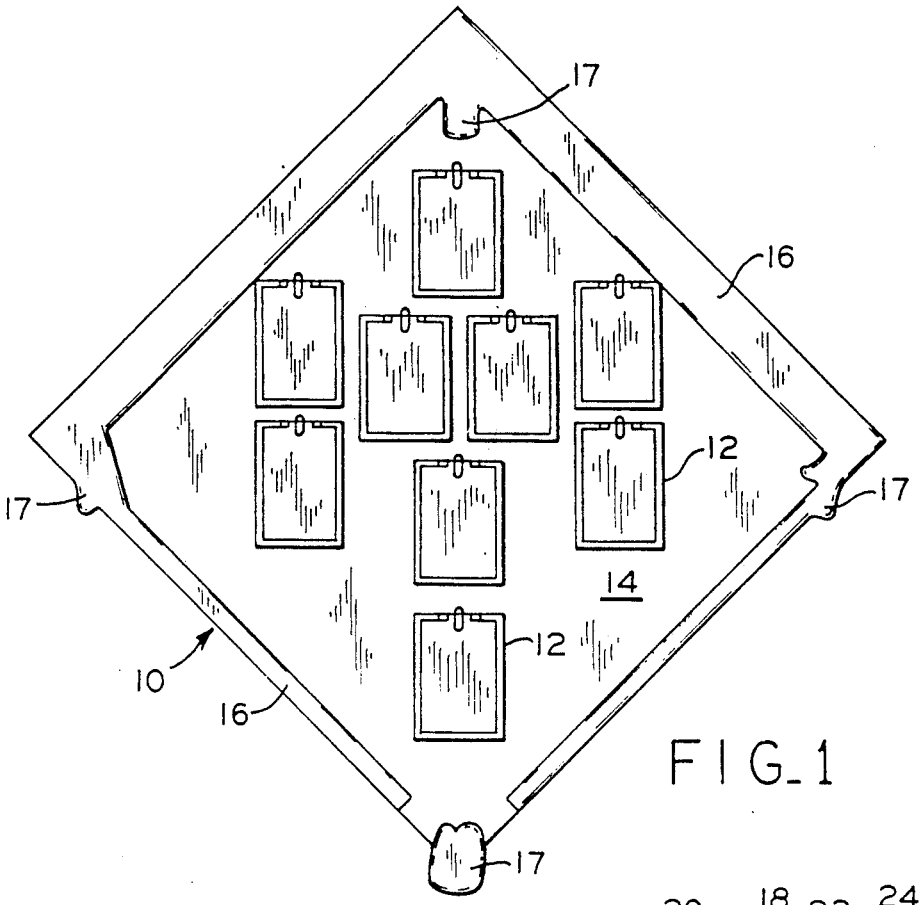
FIG. 1 is an elevational view of a card display plaque in accordance with the present invention, in its normal vertical display orientation.

Referring in particular to FIG. 1, there is illustrated a card display plaque 10 in accordance with the present invention. Plaque 10 is a generally diamond-shaped, vacuum-formed plastic sheet having a plurality of rectangular card holders 12 for receiving and holding baseball cards or the like. Plaque 10 is vacuum formed from a single sheet of relatively thin plastic to produce a relief plaque having raised and lowered areas relative to a generally flat background plane 14. A raised border 16 is elevated relative to background plane 14 primarily for decorative purposes, but also to add structural rigidity to plaque 10. Extension areas 17 of border 16 provide appropriately shaped areas on which pictures of baseball players in various poses can be imprinted, such as by silk-screening, for the purpose of decoration. Each of the card holders 12 is raised in part and lowered in part relative to background plane 14, as will be more fully described below.

Referring to FIGS. 2, 3, 4 and 5, one of the card holders 12 is shown enlarged. Each of the card holders 12 has a corresponding transparent cover that is not shown in FIG. 2, but is described below with respect to FIG. 6. A generally rectangular ridge 18 rises from background plane 14. Circumscribed by ridge 18 is a planar plateau portion 20 constituting a card-receiving area on which the back of a collector card would rest. A concave depression 22 at one end of planar portion 20 descends below the general level of plane 20 to permit one to remove a baseball card therefrom by inserting one's fingernail in depression 22 beneath the baseball card. Ridge 18, in the vicinity of depression 22, tapers downward to the level of plane 20 at ramps 24 to create an opening 25 in ridge 18 to permit lateral access by one's finger to recess 22 and thus to any baseball card lying on plane 20. Plane portion 20 is generally elevated above the level of background plane 14, but is below the level of the top of ridge 18. A finger depression 26 located outside of rectangular ridge 18 and adjacent recess 22 is depressed below the general level of background plane 14 to provide easier access for one's finger to recess 22.

Figure 6:
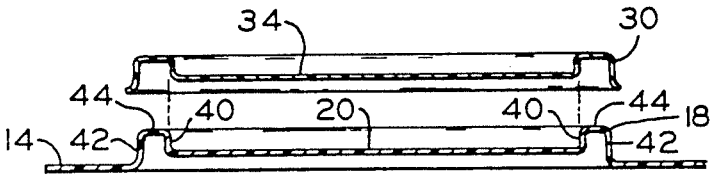
FIG. 6 is a cross-sectional view of the card display plaque of FIG. 1, taken along section line 6—6 of FIG. 2 and viewed in the direction of the arrows, and further showing the cover portion in similar cross-section.
Figure 8:
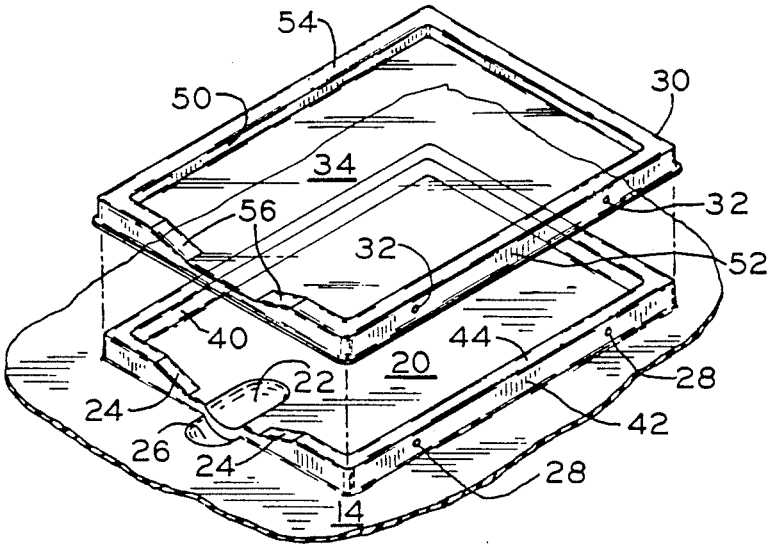
FIG. 8 is a perspective view of the portion of the card display plaque of FIG. 1 as shown in FIG. 2, together with the transparent cover shown suspended thereabove.

The general cross-sectional configuration of ridge 18 relative to surrounding background plane 14 and raised planar portion 20 is best illustrated in FIGS. 6 and 8. Ridge 18 includes an inner wall 40 standing upright from planar portion 20, an outer wall 42 parallel to and spaced from inner wall 40 and standing upright from background plane 14, and a top wall 44 extending horizontally from the top end of inner wall 40 to the top end of outer wall 42. Ramps 24 slope downwardly from the level of top wall 44 to the level of planar portion 20.

Figure 7:
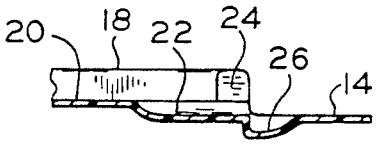
FIG. 7 is a cross-sectional view of the card display plaque of FIG. 1, taken along section line 7—7 of FIG. 2 and viewed in the direction of the arrows.

The cross-sectional configuration of depressions 22 and 26 is best illustrated in FIGS. 7 and 8, where it can be seen that depression 22 slopes downwardly from the level of planar portion 20 to the level of background plane 14. Depression 26 slopes downwardly below the level of background plane 14.

Figure 9:
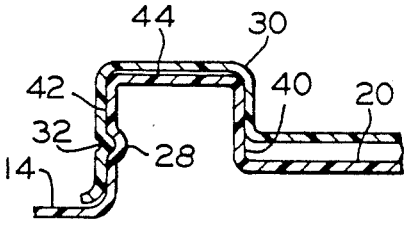
FIG. 9 is a cross-sectional view of the card display plaque of FIG. 1, taken along section line 9—9 of FIG. 2 and viewed in the direction of the arrows.
Figure 3:
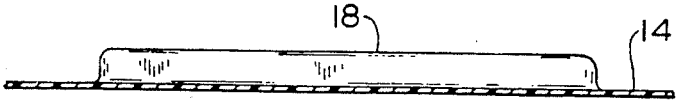
FIG. 3 is a bottom end view of the portion of the card display plaque of FIG. 1 as shown in FIG. 2.
Figure 4:
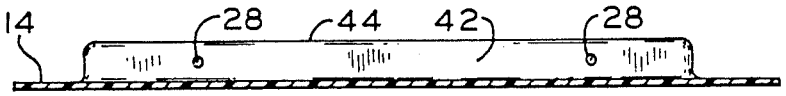
FIG. 4 is a right side view of the portion of the card display plaque of FIG. 1 as shown in FIG. 2.
Figure 5:
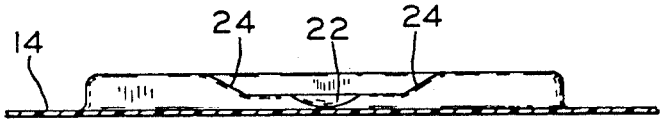
FIG. 5 is a top end view of the portion of the card display plaque of FIG. 1 as shown in FIG. 2.

Referring to FIGS. 8 and 9, the long sides of rectangular ridge 18 include a pair of dimples 28 which are useful in securing the engagement of a cover 30 (shown also in FIG. 6). Cover 30 is made of a relatively thin transparent plastic and is shaped substantially similarly to rectangular ridge 18 so as to fit thereover in form fitting fashion. Protrusions 32 on cover 30 correspond to and engage with dimples 28 when cover 30 is placed on rectangular ridge 18 to secure the two together. The baseball card, which is to be displayed, would then be sandwiched between plane 20 of the display plaque and flat center portion 34 of the cover 30.

With particular reference to FIGS. 8 and 9, it can be seen that cover 30 includes an inner wall 50 standing upright from flat center portion 34, an outer wall 52 parallel to and spaced from inner wall 50, and a top wall 54 extending horizontally from the top end of inner wall 50 to the top end of outer wall 52. Ramps 56 slope downwardly from the level of top wall 54 to the level of flat center portion 34. When cover 30 is fully engaged with rectangular ridge 18 (see FIG. 9), the clearance between flat center portion 34 of cover 30 and planar portion 20 of plaque base 10 is sufficient for approximately one collector card to be sandwiched therebetween. The thickness of most collector cards is about 0.016 inches, although there are some limited production cards on the market that have a thickness of about 0.034 inches. Thus, the clearance between cover and base is ideally in the range of 0.016 to 0.034 inches, although these dimensions do not have to be held precisely due to the inherent flexibility of the cover, which will accommodate variation in card thickness.

Figure 2:
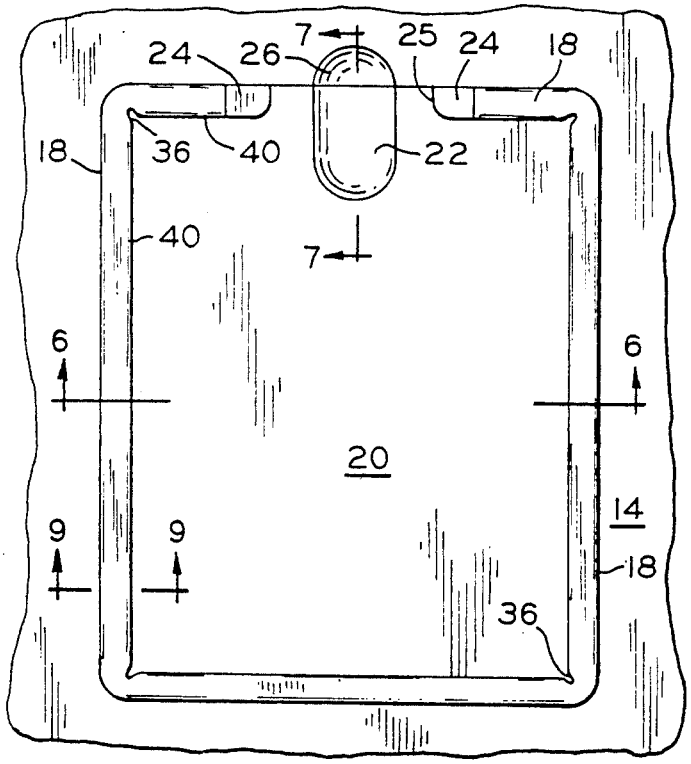
FIG. 2 is an enlarged elevational view of a portion of the card display plaque of FIG. 1, particularly showing one of the card receiving areas of the base with the cover removed.

Referring particularly to FIG. 2, corners 36 are shown to be cut away, i.e., corners 36 are recessed laterally from the point of intersection of imaginary extensions of adjacent inner sidewalls 40. Recessed corners 36 receive the sharp square corners of the collector card, thereby preserving the baseball card from damage and preventing the corners of the card from becoming bent, dog-eared, or otherwise damaged through contact with rectangular ridge 18.

Figure 10:
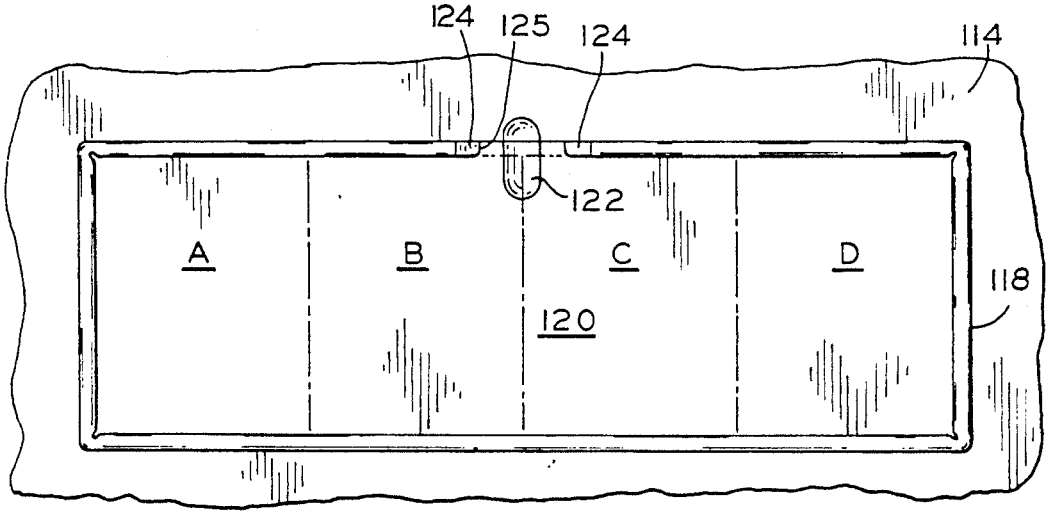
FIG. 10 is an enlarged elevational view of a an alternate embodiment of a card receiving area of the card display plaque of FIG. 1, particularly showing one of the card receiving areas of the base that is capable of receiving a plurality of collector cards side-by-side.

Referring to FIG. 10, there is illustrated an alternative embodiment of a card receiving area in which provision is made for receiving a plurality of collector cards in card locations A, B, C and D located side-by-side. Generally speaking, the embodiment of FIG. 10 is identical to the embodiment shown in FIG. 2, except for having been extended horizontally to provide adequate area to hold a plurality of collector cards within the rectangular ridge and under a single cover. Elements that are of like form and function as the elements of the embodiment of FIG. 2 are designated by like reference numerals in the 100 series. Circumscribing the plurality of collector cards is a rectangular ridge 118 rising from background plane 114 and surrounding a planar plateau portion 120. Ridge 118 slopes down to the level of planar portion 120 at ramps 124, thereby leaving an opening 125 to permit lateral access by one's finger to recess 122 and thus to any collector card lying on plane 120.

While the present invention has been particularly described in terms of a preferred embodiment, it should be understood that no limitation of the scope of the invention is intended thereby, and that the scope of the invention includes variations, uses or adaptations of the invention following the general principles thereof, including such departures from the present disclosure as come within known or customary practice in the art to which this invention pertains, limited only by the claims appended hereto.

What is claimed is:

1. A device for holding and displaying collectable cards comprising:

a base including a generally planar portion having a card receiving area thereon for receiving a collectable card, said base including a ridge upstanding from said planar portion and substantially circumscribing said card receiving area, except for an opening through said ridge that permits lateral access by a person's finger to an edge of a card received on said card receiving area, aid ridge including an outer wall upstanding from said planar portion, an inner wall spaced from said outer wall and upstanding from said card receiving area wherein said inner wall delimits said card receiving area, and a top wall spanning between and connecting said outer wall and said inner wall, said opening through said ridge being delimited by ramps tapering from the top wall of said ridge to a position level with said card receiving area, said base including a depression extending below said card receiving area and extending through said opening through said ridge for receiving one's fingernail under a collector card received on the card receiving area;

a depression extending below the planar portion outside of said card receiving area and aligned with the depression in said card receiving area; and a transparent removable cover including a generally planar portion having a card retaining area thereon for lying atop and retaining a card received on said card receiving area of said base, said cover including a groove shaped complementary to said ridge of said base portion and receiving said ridge therein in form-fitting relationship such that a card received on said card receiving area of said base is sandwiched between said planar portion of said base and said planar portion of said cover.

2. A device for holding and displaying collectable cards comprising:

a base including a generally planar portion having a card receiving area thereon for receiving a collectable card, said base including a ridge upstanding from said planar portion and substantially circumscribing said card receiving area, said ridge having inner sidewalls delimiting said card receiving area, said ridge including an outer wall upstanding from said planar portion, said inner sidewalls being spaced from said outer wall and upstanding from said card receiving area, and a top wall spanning between and connecting said outer wall and said inner wall, with adjacent ones of said inner sidewalls being disposed orthogonally to each other, said adjacent inner sidewalls having laterally recessed corners set back from a point of intersection of imaginary extensions of said adjacent sidewalls, such that a corner of a collectable card, whose adjacent sides are in engagement with adjacent inner sidewalls of said ridge, would not engage said ridge, thereby preventing damage or deformation of the corner of said collectable card;

an opening through said ridge delimited by ramps tapering from the top wall of said ridge to a position level with said card receiving area;

said base including a depression extending below said card receiving area and extending through said opening through said ridge for receiving ones's fingernail under a collector card received on the card receiving area;

a depression extending below the planar portion outside of said card receiving area and aligned with the depression in said card receiving area; and a transparent removable cover including a generally planar portion having a card retaining area thereon for lying atop and retaining a card received on said card receiving area of said base, said cover including a groove shaped complementary to said ridge of said base portion and receiving said ridge therein in form-fitting relationship such that a card received on said card receiving area of said base is sandwiched between said planar portion of said base and said planar portion of said cover.

3. The device of claim 1, in which the groove of said cover includes an outer upstanding wall, an inner upstanding wall, a top wall spanning between and connecting said outer wall and said inner wall, said generally planar portion of said cover being connected to said inner wall and lying parallel to said card receiving area.

4. The device of claim 3, in which said outer wall of said ridge of said base includes a plurality of dimples therein, and said outer wall of said groove of said cover includes a plurality of corresponding protrusions mating with said dimples to hold said cover to said base.

5. The device of claim 1, in which said device includes a plurality of separate individual card receiving areas thereon.

6. The device of claim 1, in which said device includes a card receiving area sized to receive a plurality of separate collector cards therein under one cover.

7. The device of claim 2, in which the groove of said cover includes an outer upstanding wall, an inner upstanding wall, a top wall spanning between and connecting said outer wall and said inner wall, said generally planar portion of said cover being connected to said inner wall and lying parallel to said card receiving area.

8. The device of claim 7, in which said outer wall of said ridge of said base includes a plurality of dimples therein, and said outer wall of said groove of said cover includes a plurality of corresponding protrusions mating with said dimples to hold said cover to said base.

9. The device of claim 2, in which said device includes a plurality of separate individual card receiving areas thereon.

10. The device of claim 2, in which said device includes a card receiving area sized to receive a plurality of separate collector cards therein under one cover.

* * * * *